US005290019A

United States Patent [19]

Beyers

[11] Patent Number: 5,290,019

[45] Date of Patent: Mar. 1, 1994

[54] ADJUSTABLE SIDING INSTALLATION HANGER ASSEMBLY

[76] Inventor: Gerald W. Beyers, 2865 Lilac La., Fargo, N. Dak. 58102

[21] Appl. No.: 903,092

[22] Filed: Jun. 23, 1992

[51] Int. Cl.[5] ..... B23Q 3/00

[52] U.S. Cl. ..... 269/43; 269/46; 269/102; 269/904

[58] Field of Search ..... 294/82.11, 82.13, 74; 24/71.3, 71.2; 269/46, 43, 102, 904; 33/501; 298/222.4, 225.1, 223.2, 225.2, 497, 498; 52/547, 543, 551, 556, 125, 105, 748

[56] References Cited

U.S. PATENT DOCUMENTS

| | | | |
|---|---|---|---|
| 76,146 | 3/1868 | Barnum | 24/71.3 |
| 2,095,295 | 10/1937 | Smith et al. | 269/46 |
| 2,597,210 | 5/1952 | Walters | 24/71.3 |
| 2,683,937 | 7/1954 | Criswell | 24/71.3 |
| 3,904,184 | 9/1975 | Krueger | 269/904 |
| 4,089,141 | 5/1978 | Heroux | 269/102 |
| 4,254,945 | 3/1981 | Paulson et al. | 269/102 |
| 4,272,065 | 6/1981 | Steenson et al. | 269/904 |
| 4,779,816 | 10/1988 | Varlet | 24/71.3 |

FOREIGN PATENT DOCUMENTS 182901 8/1906 Fed. Rep. of Germany ..... 269/46

*Primary Examiner*—Robert C. Watson

*Attorney, Agent, or Firm*—Hubbard, Tucker & Harris

[57] ABSTRACT

A siding installation hanger has a elastic cord storing mid-section from which opposite extending legs having backturned end portions extend. The backturned end portions have gripping edges which in response to tension in the elastic cord, easily and removably grip the protruding longitudinal lip on siding strips which interlock. The upper end section of the hanger strap releasably retains the rope and may include hook-like slotted portions for that purpose. The hanger strap is retained in a upright vertical position in support of horizontal siding strips. Loose wraps are wound around the elastic cord storage section of the hanger member to ensure that the elastic cord is always the proper length to tensively hold successive siding strips at any vertical location along the wall surface to be sided. The device is quickly and easily adjusted and quickly and easily removed. A method employing the device for installing siding is included.

23 Claims, 2 Drawing Sheets

ADJUSTABLE SIDING INSTALLATION HANGER ASSEMBLY

BACKGROUND OF THE INVENTION

1. Field of the Invention

The invention relates to an improved apparatus and method for supporting successive siding strips as they are being installed along a vertical wall surface.

2. Background of the Prior Art

External wall surfaces of buildings, both commercial and residential, are often sided with prefabricated siding strips most frequently made of metal or plastic. The siding strips are prefabricated with edges that interlock. Usually, the bottom longitudinal edge is underturned and the top longitudinal edge is folded to produce an overhanging longitudinal edge into which the underturned edge of the adjacent piece is interlocked and which hides any connection between the two pieces. The extreme top edge of the strip is nailed or stapled to the wall before the lower edge of the next higher piece is interlocked into the upper edge to cover the seam between the pieces.

Installation is from the bottom up and the successive siding strips are placed in horizontal orientation along the wall surface. Although a solid wall surface is produced when the individual siding strips are fastened to the wall and interlocked, the individual strips themselves are relatively narrow in width in comparison with their length. They are lengthy thin strips that are difficult to handle. It is not unusual to have some that may be 65 to 75 feet long and only about a foot wide. These rather lengthy narrow siding strips are very difficult for one or even two men to install upon a wall surface. Each strip must be supported in its horizontal position, with its seam fully interlocked, while a fastener is started into the wall through the siding strip to hold it in position. If the piece slips while it is being fastened, a defect is created and the succeeding strips may be out of level. Damage may occur.

It is highly desirable to provide an apparatus for supporting each sequential horizontal siding strip in position, with its lower edge in interlocked contact with the upper edge of the previous strip in order to provide a sure, quick and cheaper installation with a smaller crew and with fewer defects due to faulty installation procedure. Such a device must be adjustable in order to accommodate siding strips at a plurality of elevations as the strips are laid up along the wall surface. Such a device should be quickly and easily engageable and disengageable with a given siding strip without clamps, screws, suction cups or other mechanical apparatus. Significant labor saving has important consequences in fostering economic construction.

SUMMARY OF THE INVENTION

The present invention is an easily adjustable hanger assembly for installing sequential horizontal siding strips to form siding on a wall surface. A lengthy rope extensible for stretching, which may be referred to as a shock cord or "BUNGEE" cord, has a hanger element on one end. The elastic rope or cord is temporarily attached to the wall surface above the area to be sided. The elastic rope should be long enough to reach the lowest siding strip to be installed. Attached to the lower end of the rope is a manually manipulatable hanger strap having a rope shortening mid-section for receiving wrapped short sections of the rope to selectively adjust the length of the elastic rope. Oppositely extending from the rope shortening mid-section are upper and lower end sections having respective upper and lower end portions, at least the lower end portion being adapted for temporary support of independent individually horizontally oriented siding strips, by engagement in response to tension in the rope, with a projecting lip formed along the top of the strips and extending longitudinally along its length. The lower end portion of the lower end has a gripping distal profile for engagement with the projecting lip or ridge running longitudinally along the siding strips. The upper opposite end of the manually manipulatable hanger strap is adapted for being retentively wrapped by the rope hanging from above, to secure the hanger strap in an upright position while the lower end portion temporarily engages the projecting lip on a given siding strip.

In a preferred embodiment, the manipulatable hanger is a strap-like member having a width which is substantially greater than its thickness. The lower end portion may be formed by angling back the end of the lower end section and providing a gripping distal profile in such a way as to form a stand-off which in operative siding holding position, raises the hanger strap outwardly from the wall surface spaced apart away from the siding to avoid damaging it. The upper end portion may have a hook-like portion for releasably holding the rope to secure the hanger strap in an upright position. The upper end portion may also be equipped with a stand-off which holds it away from the wall surface to maintain a straight pull when supporting the siding strip.

In a further preferred embodiment, the strap-like hanger may be formed from a single strap having a U-shaped midsection and both the upper and lower end sections may have angled back end portions which have gripping distal profiles for engagement of siding strips. With this embodiment, either the upper or lower end sections can be reversed by rotating 180 degrees so that either end can be used to support a siding strip while the other end releasably engages the rope by wrapping the rope partially around the angled end portion to secure the hanger in an upright orientation. The elastic rope is most preferably a "BUNGEE" cord which has sufficient lifting strength to hold and support siding and substantial stretchability to make it easy to use in mounting horizontally successfully higher strips at various locations from the bottom to the top of the wall surface.

In the preferred method, a specialized starter strip may be mounted along the base of the wall or the first strip may simply be one of the siding strips which has been formed in the same manner as the remainder of the strips. The first strip or starter strip is carefully fastened while positioned horizontally so that each successive strip will automatically be oriented horizontally during subsequent installation. Any excess stretchable cord is wrapped around the mid-section, which comprises a cord storage means to store any loose or excessive cord. This is adjusted so that the cord will have to be stretched in order for the gripping edge of the bottom extension of the hanger will reach the longitudinal, projecting lip on the upper edge of the next siding strip to be installed. Several of the devices may be employed laterally along the wall to pull the next successive siding strip upwardly with its lower interlocking edge engaged under the projecting lip of the first or starter strip in response to tension in the rope caused by stretching.

The rope is partially wrapped under the angled back upper end portion or passed through hook-like rope retaining slots or an eye fastened to the upper end section to maintain a straight pull on the hanger strap. This keeps the manually manipulatable hanger strap in an upright orientation so that the lower gripping end is not rotated or twisted which would tend to cause it to lose its grip on the siding strip. Tension holds it in place.

Now with the siding strip securely hung and supported by the hanger assembly, the siding strip is nailed or fastened along its upper edge to the wall surface. The hanger straps can be quickly and easily removed from the now affixed siding strip they were supporting by simply stretching the cord to instantly release the gripping edge from the lip at the top of the siding strip.

The next succeeding siding strip is then raised into position with the interlocking lower edge in contact with the upper interlocking edge of the siding strip which has just been affixed to the wall. The hanger assembly is adjusted by taking another wrap around the rope shortening mid-section in order to shorten the "BUNGEE" cord so that the adjustable hanger assembly will again have to be stretched in tension in order to reach the upper protruding edge of the next successive siding strip. The cord is then stretched and placed into position to pull the next successive siding strip up into proper horizontal orientation with its lower edge interlocked with the upper edge of the previous siding strip now attached to the wall. After that siding strip has been fixed to the wall, the next siding strip is raised into position and the process is repeated, each time shortening the adjustable hanger assembly by wrapping enough of the elastic cord around the cord storing mid-section so that the elastic rope will have to be stretched in order for the hanger strap to reach the top projecting lip of the successive siding strip to be supported.

It is easily seen that the process of releasing the rope from the upper end section and wrapping additional wrap of the elastic rope around the rope storing mid-section is almost an instantaneous process, which the installer with only a small amount of practice, can do quickly and easily to adjust the hanger assembly for each succeeding siding strip as he proceeds installing siding strips successively up the wall surface. The hanger strap is almost instantly attached or released from the projecting longitudinal edge of the siding strips, yet holds securely because of the continuing elastic tension in the rope.

DETAILED DESCRIPTION

Figure 1:
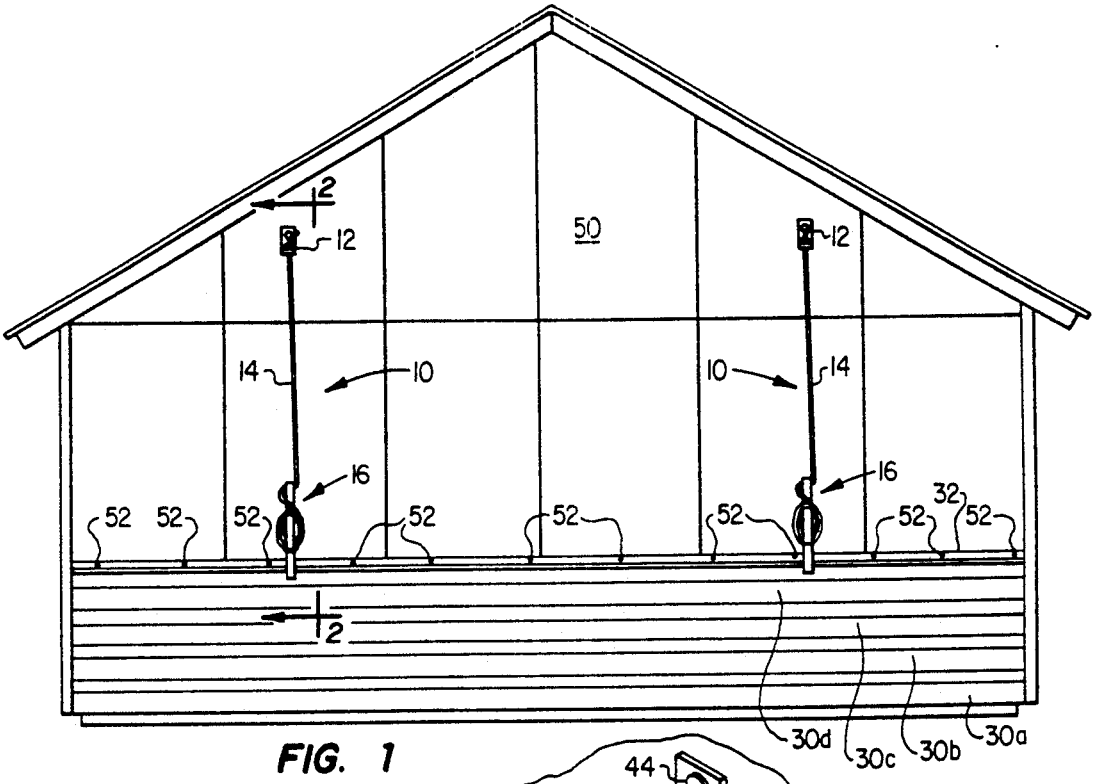
FIG. 1 is an elevation view of a wall surface partially sided with siding strips, showing two adjustable hanger assemblies holding the uppermost strip in horizontal orientation whereby it can be affixed to the wall along its top edge.

In the description that follows, like parts will be referred to by the same reference numeral insofar as possible. The drawings are not necessarily to scale and may be altered somewhat in the interest of clarity.

Figure 2:
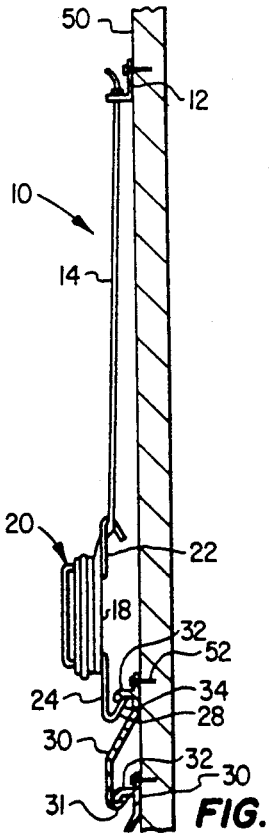
FIG. 2 is a cross sectional vertically compressed side elevation view of an adjustable hanger assembly showing how a siding strip is supported and how the bottom longitudinal edge of one strip interlocks with the top longitudinal edge of a previous strip.
Figure 3:
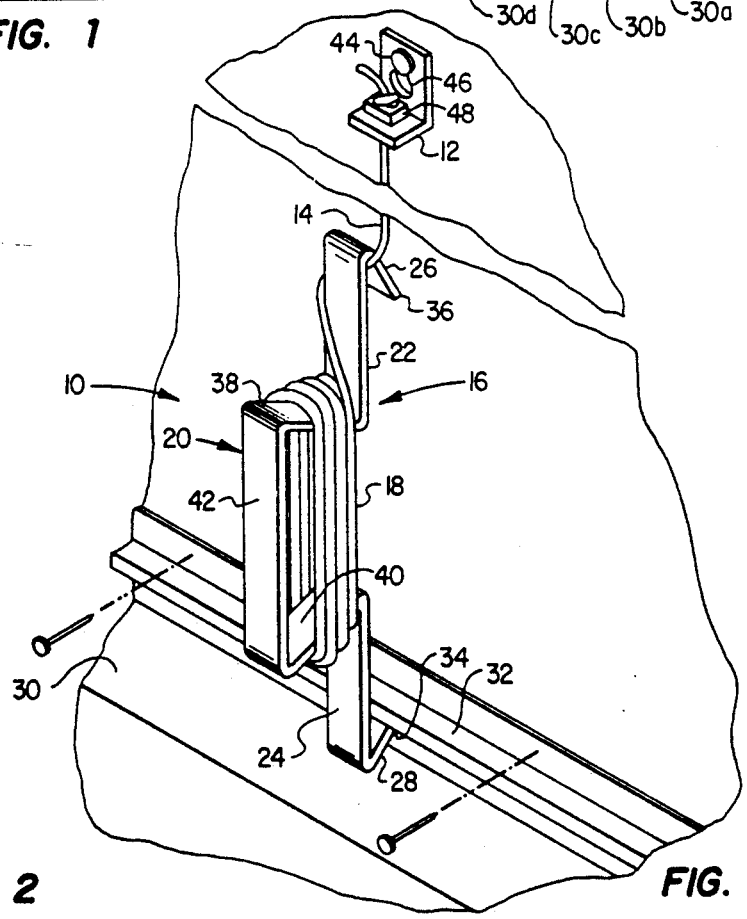
FIG. 3 is a perspective view of the hanger shown in FIG. 2 showing a temporary bracket which holds the upper end of the elastic shock cord.

The preferred embodiment of the adjustable hanger assembly is perhaps best illustrated in FIGS. 2 and 3. It should be noted that in the side view of FIG. 2, the drawing has been compressed in the vertical direction for convenience. The individual siding strips are often made about the width of three simulated lapstrake boards.

Adjustable hanger assembly 10 is shown supporting one of a plurality of successive horizontally oriented siding strips to form siding on a wall surface. Assembly 10 has a bracket 12, an elastic cord or rope 14 and a manually manipulatable hanger strap generally designated 16. The elastic rope is supported from the hanger 12 above the area to be sided. The other end of the elastic rope is fixedly connected to hanger strap 16, its length depending upon the elevation for a particular siding strip to be installed. It may have a number of turns 18 wound around a rope storing mid-section 20. Mid-section 20 serves to shorten the elastic cord to selectively adjust the length of the rope. Hanger strap 16 has oppositely extending upper end section 22 and lower end section 24 extending from mid-section 20. Upper end section 22 has a turned back end portion 26 and lower end section 24 has a turned back lower end portion 28. The end portions are adapted for temporarily supporting individually horizontally oriented siding strips 30 by engagement in response to tension in elastic cord 14, with a longitudinally extending projecting lip 32 of the individual siding strips. Lower end portion 28 terminates in a gripping distal end 34 which comes into contact with the projecting edge of the siding strip. Similarly, upper end portion 26 terminates in distal end 36.

Mid-section 20 has a pair of legs 38, 40 from which the upper and lower end portions extend, the legs 38, 40 being slightly angled from a perpendicular to the upper and lower end sections 22, 24. Mid-section 20 has a handle portion 42 which connects the ends of the outwardly extending legs 38, 40 and together they form a storage means for wraps 18 of line 14. Handle portion 42 also makes it easy to manipulate assembly 10. Outwardly angled legs 38, 40 make a slightly acute angle with the upper and lower end sections in the form of a generally "U" shaped storage means. This has the benefit of making it less likely that any loose coils 18 of the elastic cord will slip off while assembly 10 is being handled. Finally, bracket 12 is secured by means of keyhole opening 46 to an incompletely driven nail 44. Bracket 12 is angled to form a ledge which holds a nut 48 through which the end of rope 14 is passed and knotted to provide support for the adjustable hanger assembly.

Referring now to FIG. 1, wall surface 50 is seen to be the surface to be sided by successive siding strips 30*a–d*. Siding strip 30*a* may be a special starter strip which serves as an anchor and positioning member for the next successive strip 30*b* or, starter strip 30*a* could be like the other starter strips. In either event it is first affixed in a horizontal orientation to serve as a base and a guide for the succeeding starter strips 30*b*, 30*c*, 30*d* and so forth. Each of the starter strips generally designated as starter strips 30, have a longitudinally extending projecting lip 32 on the upper side and an underturned longitudinally extended projecting lip 31 on the lower edge which interlock when they are pulled up against each other with an underturned lip 31 in contact with a projecting lip 32. Actually, in metal siding, the upper lip 32 is formed by a folded over portion of the wall in what is known in the art as a "Pittsburgh seam". This forms a crevice into which the edge of the underturned lower edge 31 is lodged and frictionally engaged.

In operation, one or more of the easily adjustable hanger assemblies 10 are mounted on wall surface 50 with the elastic cord 14 hanging down long enough so that hanger strap 16 can reach the bottom most siding strip to be installed. Brackets 12 can be temporarily fastened to the wall as indicated in FIG. 1 or from some other portion of the roof overhang in the upper portion of the wall to be sided. The brackets are preferably mounted relatively close to the wall surface so that the cord hangs down relatively close to the wall surface. The elastic cord is unwound from the cord storing mid-section of the hanger to reach the siding strip to be installed at any particular location along the wall surface. Normally, the elastic cord would be long enough to handle the highest wall to be sided, so there would usually be excess cord wrapped around the mid-section.

After the first siding strip or starter strip, as the case may be, is leveled and fixed to the bottom of the wall surface, the next succeeding siding strip is lifted into position so that its longitudinally extending lip 31 is in contact with longitudinally extending lip 32 on the first or starter strip, as the case may be. The installer stretches the cord and hooks the distal edge 34 under lip 32 of the siding strip to be installed so that the cord is in tension by stretching. If a second or additional laterally spaced hangers 10 are employed, the installer moves laterally while holding the siding strip and stretches and engages the additional assembly 10 so that its distal end 34 of end portion 28 catches lip 32 and lifts it against the interlocking lip 31 of the already affixed siding strip. The operator may now lightly tap the now supported successive siding strip to ensure that the interlocking edges are uniformly engaged along the length of the strip as it is hanging by the tensioned hanger assemblies.

Referring now to FIG. 1, nails or staples 52 are driven across the top edge of the siding strip which is being supported to affix it to the wall. All the operator has to do to remove the hanger assemblies is to slightly stretch the cord and pull them below and away. Note that the cord which extends from the mid-section is retentively partially wrapped around the turned back end portion of upper end section 22 so that the hanger strap, in response to tension in the elastic cord, hangs in vertical orientation. This prevents any tendency for the hanger strap to twist or otherwise lose its grip on the upper projecting lip 32 of the siding strip.

Once the siding strip is affixed, the hanger strap is instantly releasable, the partially wrapped portion of the elastic cord is quickly and easily removed from around the upper end section. One or more half turns of the hanger strap collects the excess rope and raises the hanger strap by shortening the elastic cord for installation of the next succeeding strip. After it is returned to the orientation of FIG. 3, the next successive hanger strap is placed in position and hooked with the hanger strap to repeat the process. This greatly simplifies the process of installing siding strips along the wall surface and makes it possible to do so with only one installer.

Each time a siding strip is affixed to the wall, the elastic cord is shortened by wrapping around the mid-section so that tension can be applied to support the next siding strip to be installed. In the preferred embodiment of FIGS. 2 and 3, the oppositely extending end sections and end portions are identical and either may be used to hold the siding strip or releasably retain the rope. This is especially convenient when the installer reaches the upper portion of the wall where the rope is short because only a 180 degree turn is required to provide some shortening of the rope without creating excessive tension by making the rope too short. It is convenient to make the hanger strap by making appropriate bends in a single piece of metal strap having a width substantially greater than its thickness. The distal gripping edges 34, 36 may be beveled to a dull point to provide a better grip for engagement of siding strips.

Figure 4:
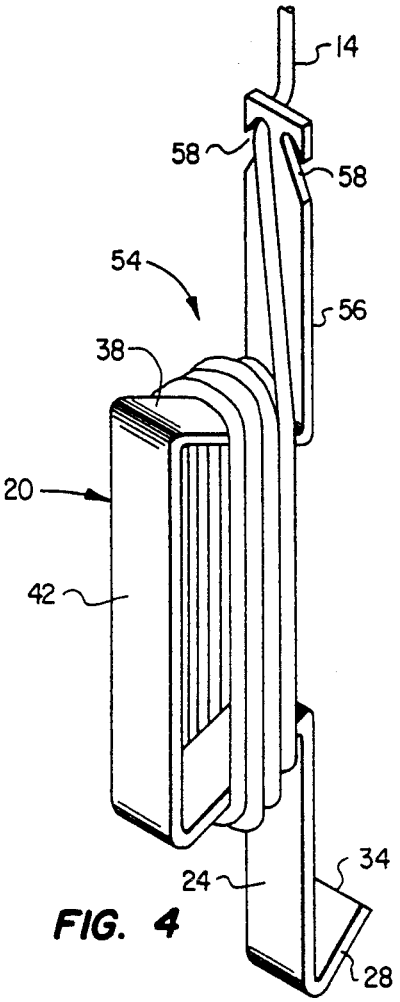
FIG. 4 is a perspective view of a modified version of the hanger assembly in which the upper end section has hook-like cord retaining slots to hold the cord so that the handle member remains in upright orientation.
Figure 5:
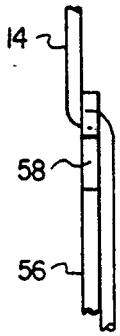
FIG. 5 is a cutaway side view of the upper end portion of FIG. 4 showing that the cord may be retained in a different fashion.

In FIGS. 4–8 are shown some variations of the end sections and end portions which may be employed in combination with each other. In FIG. 4, hanger strap 54 has a mid-section and a lower end section just like FIGS. 2 and 3. The upper end section 56 is modified by providing a pair of slotted openings 58, open on either side edge to releasably retain the elastic cord 14. FIG. 5 shows that the elastic cord may be releasably releasably retained from along the outer surface of upper end portion 56 or may be releasably retained from the undersurface of upper end section 56.

Figure 7:
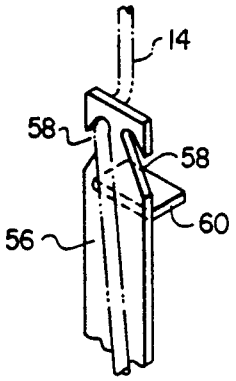
FIG. 7 is a partial perspective view showing the upper end portion of FIG. 4, varied to include a standoff which holds the upper end position apart from the wall surface.

FIG. 7 shows the cutaway upper end portion of FIG. 4 in which a standoff 60 has been fastened to the underside of upper end portion 56 to serve as a standoff to keep the hanger strap away from the siding being supported and the elastic cord away from the wall.

Figure 8:
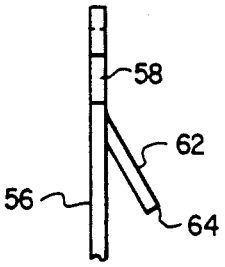
FIG. 8 is a partial side view of the embodiment of FIG. 7 in which the standoff portion is angled back to serve as a gripping edge adapted for temporary support of the siding strip so that either end can be used for support.

FIG. 8 shows a modification in which an angled standoff 62 is connected to the underside of upper end portion 56. Angled standoff 62 is thus adapted to use to engage the projecting lip of a siding strip. In this embodiment, both the upper and lower end sections could be made like FIG. 8 so that the hanger strap could be utilized to support siding from either the upper or lower end section at distal end 64. As before, distal end 64 can be beveled to provide a gripping edge. Either of the end portions having hook-like slotted openings 58 could be used to releasably retain the rope to hold the hanger strap in vertical orientation.

Figure 6:
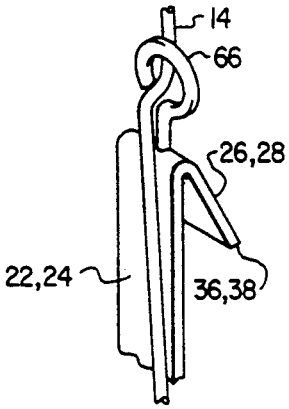
FIG. 6 is a cutaway perspective view of an upper or lower end portion having an angled back gripping edge and a hook-like eye for retentively engaging the cord to hold the hanger strap in an upright orientation.

FIG. 6 shows a modification of the embodiment of FIG. 3 in which one or both ends may have a fixed thereto a hook eye connected at approximately the bend between end section 22, 24 and end portion 26, 28 so that the elastic cord can be temporarily retentively retained by the eye instead of wrapping around the angled back end portion. Any other variations along similar lines could be thought of once the basic concept is understood.

In the best mode, the hanger strap may be bent from a metal strap approximately ⅛" thick and the bungee cord may be passed through an opening between the mid-section and upper end section in the vicinity of the bend and fastened by means of a metal fastener compressed around the cord to hold it in place. This location tends to avoid a torque in case the cord is completely let out for an extra long installation. Once a wrap or two is taken around the mid-section, it would not matter where the end of the elastic cord was fastened to the hanger strap.

The elastic cord is preferably approximately a ⅜" bungee cord which has a sufficiently good load-carrying capacity and yet is readily stretchable by the installer. It needs to stretch roughly at least 48 inches in a 30 foot length. The invention can be used with seamless siding or what is known as box siding, as well.

In some cases, the triangular upper section of the wall would have a different facing material or have vertically extending siding. If horizontally installed siding were to be employed in the triangular upper section, the length becomes sufficiently shorter in the extreme upper portions that an installer on a ladder can install the shorter pieces without the aid of the invention.

Although a preferred embodiment of the invention has been described in detail, it should be understood that various substitutes, alterations and modifications can become apparent to those skilled in the art. These modifications can be made without departing from the spirit and scope of the invention as defined in the appended claims.

I claim:

1. An easily adjustable hanger assembly for installing successive horizontal siding strips to form siding on a wall surface, comprising:

a lengthy elastic rope extensible for stretching, having one free end for securing said rope elevated above and along a wall surface to be sided, the rope being long enough to reach the lowest siding strip to be installed;

a manually manipulatable hanger strap connected to the other end of said rope having:

a rope shortening mid-section for receiving wrapped short sections of the rope to selectively adjust the length of the rope, oppositely extending upper and lower end sections extending from the mid-section, the end sections having respective upper and lower end portions, at least the lower end portion being adapted for temporary support of individual horizontally oriented siding strips by engagement in response to tension in the rope, with a projecting lip formed along said strips;

wherein said hanger assembly is operable for holding sequential ones of horizontally oriented siding strips in position for nailing on a wall surface, upon securing said one free end of the rope in said elevated position, winding slack portions of the extensible rope around the mid-section of the hanger strap, so that the lower end portion of the hanger strap engages a projecting lip on sequential ones of said strips while the extensible rope is tensioned by stretching.

2. The assembly of claim 1 wherein the upper end portion of the hanger strap is adapted for being retentively wrapped by the rope to secure the hanger strap in an upright position while the lower end portion temporarily engages the projecting lip on a given siding strip.

3. The assembly of claim 2 wherein the upper and lower end portions are both interchangeably adapted for temporary support of individual horizontally oriented siding strips, by engagement in response to tension in the rope with a projecting lip formed along said strips and for being retentively wrapped by the rope, so that either can be used to secure the hanger strap in an upright position while the other temporarily engages the projecting lip on a given siding strip.

4. The assembly of claim 3 wherein the upper end portion of the hanger strap is adapted in such a way as to form a standoff which in operative siding holding position, raises the hanger strap outwardly away from the wall surface.

5. The assembly of claim 4 wherein the lower end portion of the hanger strap is adapted in such a way as to form another a standoff which in operative siding holding position, raises the hanger strap outwardly from the wall surface.

6. The assembly of claim 2 wherein the lower end section of the hanger strap is a strap-like member having a width which is substantially greater than its thickness.

7. The assembly of claim 6 wherein the lower end portion is formed by angling back the end of the lower end section and providing a gripping distal profile on the lower end portion for engagement of siding strips.

8. The assembly of claim 7 wherein the upper end portion has a hook-like portion for releasably holding the rope to secure the hanger strap in an upright position.

9. The assembly of claim 6 wherein the upper end portion is a strap-like member having a width substantially greater than its thickness.

10. The assembly of claim 9 wherein the assembly includes the free end of the rope having a hanger member.

11. The assembly of claim 9 wherein the upper end portion is formed by angling back the end of the upper end section and providing a gripping distal profile on the upper end portion for engagement with siding strips, so that either of the upper or lower ends can be interchangeably used to engage the siding strips and the other can be retentively wrapped by the rope to secure the strap in a upright operative position by rotating the hanger strap 180 degrees.

12. The assembly of claim 11 wherein the mid-section is a strap-like member having a width substantially greater than its thickness.

13. The assembly of claim 12 wherein the mid-section and end sections comprise a single strap-like member.

14. The assembly of claim 13 wherein the mid-section has a generally "U" shaped profile with the legs of the U connected at approximately right angles to the upper and lower end sections.

15. The assembly of claim 14, wherein the mid-section and end sections of the hanger strap are formed by bending a continuous length strap member.

16. The assembly of claim 11 wherein the rope is an elastic shock cord known as a "Bungee" cord.

17. The assembly of claim 16 wherein the assembly includes the free end of the rope having a hanger member.

18. An easily adjustable hanger assembly for installing sequential siding strips to form siding on a wall surface, comprising:

an elastic rope having a support on one end for attachment at an elevated position above a wall surface to be sided, having another end being long enough to hang along the wall to be sided by mounting sequential siding strips thereon;

a manipulatable hanger strap connected to said other end of the rope, having a mid-section suitable for being wrapped by the rope in order to selectively shorten the rope according to the elevation of a given siding strip to be mounted horizontally successively higher at locations along a wall surface;

oppositely extending first and second end sections extending from the mid-section, having respective first and second end portions which are hook shaped for engagement in operative position under tension with a projecting lip formed along said siding strips and for releasably retaining the tensioned rope to secure the hanger strap in an upright position when one of the hook shaped end portions is temporarily hooked under the projecting lip of a siding strip and the tensioned rope is passed around the other of the hook shaped end portions;

whereby, when the rope is hung by the support along a wall to be sided, a successive siding strip can be temporarily held and supported for permanent mounting and the hanger assembly can be quickly and easily attached to or removed from a given siding strip by stretching the elastic rope, the rope being shortenable to support higher succeeding strips by simply winding additional excess rope on the mid-section of the hanger strap and stretching the elastic rope while engaging a siding strip with a hook shaped end portion.

19. The assembly of claim 18 wherein the first and second end portions are formed by angling back the ends of the respective first and second end sections and providing a gripping distal profile on each end portion for engagement with siding strips.

20. The assembly of claim 19 wherein the mid-section and end sections comprise a single strap-like member.

21. The assembly of claim 20 wherein the mid-section has a U-shaped profile having leg portions which connect at right angles with the first and second end sections.

22. The assembly of claim 21 wherein the mid-section and end sections are formed by bending a continuous length strap member.

23. The assembly of claim 22 wherein the elastic rope is an elastic shock cord known as a "Bungee" cord.

* * * * *